US005362123A

United States Patent [19]

Simmons

[11] Patent Number: 5,362,123

[45] Date of Patent: Nov. 8, 1994

[54] WALL MOUNTED CHILD SEATS WITH FOLD-UP CAPABILITIES

[76] Inventor: Sharon L. Simmons, 1365 Lawndale, Eldorado, Kans. 67042

[21] Appl. No.: 151,003

[22] Filed: Nov. 12, 1993

[51] Int. Cl.[5] ..... A47D 1/10

[52] U.S. Cl. ..... 297/14; 297/255; 297/464

[58] Field of Search ..... 297/14, 254–256, 297/464, 467

[56] References Cited

U.S. PATENT DOCUMENTS

| | | | |
|---|---|---|---|
| 2,359,599 | 10/1944 | Allen | 297/255 X |
| 2,690,790 | 10/1954 | Linden | 297/255 |
| 3,272,554 | 9/1966 | P'Simer | 297/256 |
| 3,288,502 | 11/1966 | Romay | 297/255 X |
| 4,723,493 | 2/1988 | Siani et al. | 297/14 X |

FOREIGN PATENT DOCUMENTS

| | | | |
|---|---|---|---|
| 229736 | 2/1963 | Austria | 297/255 |
| 569925 | 6/1945 | United Kingdom | 297/255 |

*Primary Examiner*—Peter R. Brown
*Attorney, Agent, or Firm*—Michael J. Colitz, Jr.

[57] ABSTRACT

A child seat positionable between an operative deployed orientation and an inoperative storage orientation comprising a main support frame in a generally inverted U-shaped configuration having a pair of parallel vertical legs and a single horizontal leg coupled therebetween at the upper extent of the vertical leg; attachment brackets secured to each vertical leg at an upper extent thereof and at a lower extent thereof for coupling the main support frame to a horizontal surface such as the wall of a bathroom; a pivotable frame formed with linear parallel legs and with hinge means coupling the inboard end thereof to a central extent of the vertical legs of the main support frame intermediate the brackets, the pivotable frame also having an elongated cross leg at the outboard ends of the parallel legs; a flexible fabric cover having inboard ends coupled to the vertical and horizontal legs of the main support free and outboard ends coupled to the parallel and cross leg of the pivotable frame; and a strap coupling intermediate extents of the vertical legs of the main support frame and the parallel legs of the pivotable frame to limit downward movement thereof.

4 Claims, 3 Drawing Sheets

FIG. 1
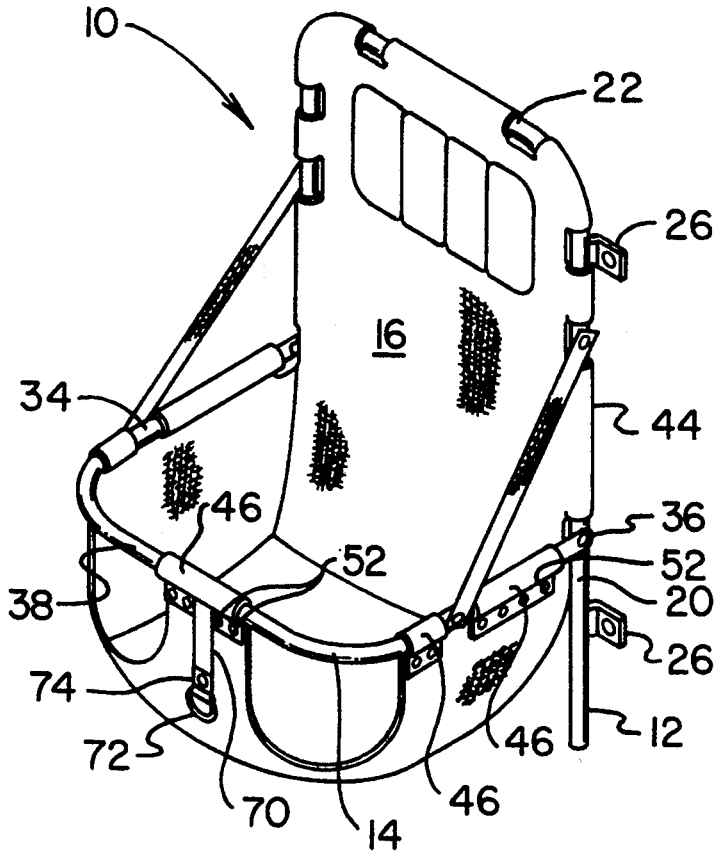
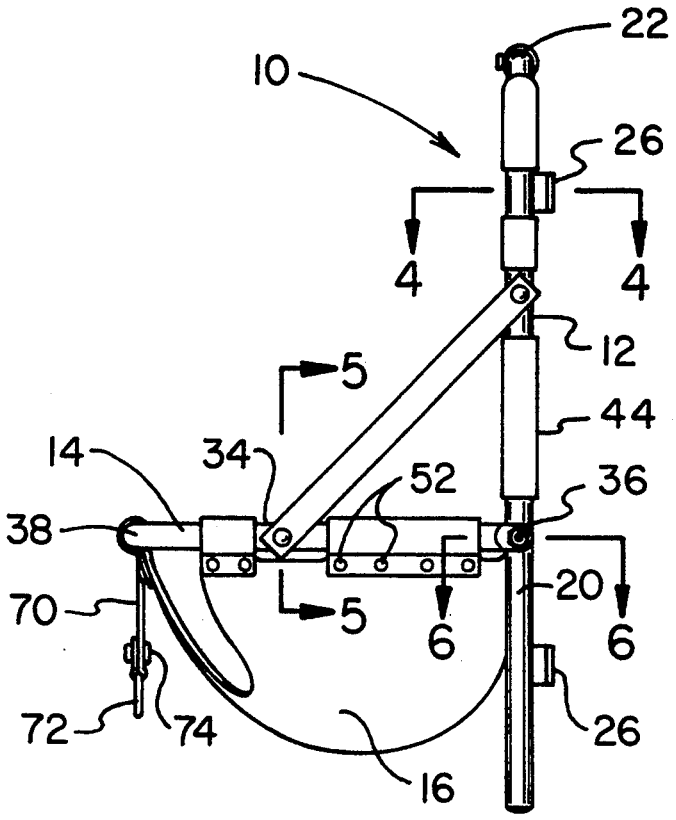
FIG. 2

FIG. 3
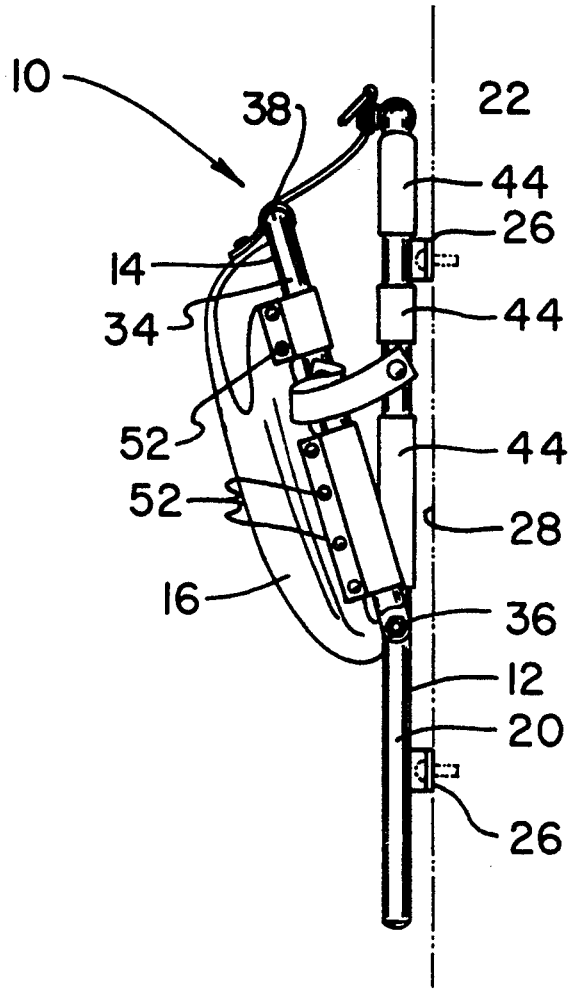
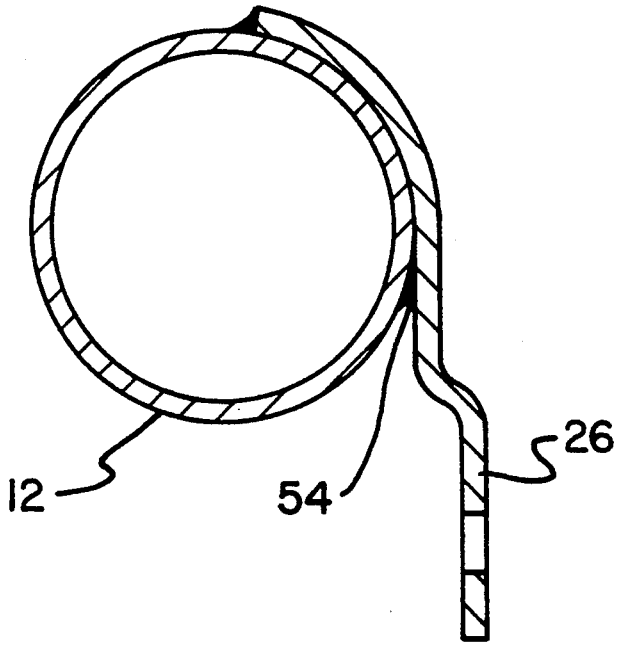
FIG. 4

WALL MOUNTED CHILD SEATS WITH FOLD-UP CAPABILITIES

BACKGROUND OF THE INVENTION

1. Field of the Invention

The present invention relates to wall mounted child seats with fold-up capabilities and more particularly pertains to safely seating a child in a public restroom in a convenient, fold-up seat.

2. Description of the Prior Art

The use of child seats is known in the prior art. More specifically, child seats heretofore devised and utilized for the purpose of seating a child are known to consist basically of familiar, expected, and obvious structural configurations, notwithstanding the myriad of designs encompassed by the crowded prior art which has been developed for the fulfillment of countless objectives and requirements.

Child seats of various configurations are found throughout the prior art. By way of example, U.S. Pat. Nos. 4,568,122 to Kain and 4,662,683 to Knoedler disclose seats for children for use in vehicles having pivotable restraints moveable from an operative orientation in front of the child to an inoperative rotation rotated thereaway.

U.S. Pat. No. 4,906,047 to Mikami discloses a child car seat with a waist support and a support for the upper torso.

U.S. Pat. No. 4,537,446 to Roney discloses a seat for an adult with side and front supports.

Lastly, U.S. Pat. Nos. 4,080,439 and 5,183,315 to Takahashi disclose child seats for use in bathrooms and the like.

In this respect, the wall mounted child seat with fold-up capabilities according to the present invention substantially departs from the conventional concepts and designs of the prior art, and in doing so provides an apparatus primarily developed for the purpose of safely seating a child in a public restroom in a convenient, fold-up seat.

Therefore, it can be appreciated that there exists a continuing need for new and improved wall mounted child seats with fold-up capabilities which can be used for safely seating a child in a public restroom in a convenient, fold-up seat. In this regard, the present invention substantially fulfills this need.

SUMMARY OF THE INVENTION

In view of the foregoing disadvantages inherent in the known types of child seats now present in the prior art, the present invention provides improved wall mounted child seats with fold-up capabilities. As such, the general purpose of the present invention, which will be described subsequently in greater detail, is to provide new and improved wall mounted child seats with fold-up capabilities and methods which have all the advantages of the prior art and none of the disadvantages.

To attain this, the present invention essentially comprises a child seat positionable between an operative deployed orientation and an inoperative storage orientation comprising, in combination, a main support frame in a generally inverted U-shaped configuration having a pair of parallel vertical legs and a single horizontal leg coupled therebetween at the upper extent of the vertical leg; attachment means secured to each vertical leg at an upper extent thereof and at a lower extent thereof for coupling the main support frame to a horizontal surface such as the wall of a bathroom; a pivotable frame formed with linear parallel legs and with hinge means coupling the inboard end thereof to a central extent of the vertical legs of the main support frame intermediate the brackets, the pivotable frame also having an elongated cross leg at the outboard ends of the parallel legs; a flexible fabric cover having inboard ends coupled to the vertical and horizontal legs of the main support frame and outboard ends coupled to the parallel and cross leg of the pivotable frame; a strap coupling intermediate extents of the vertical legs of the main support frame and the parallel legs of the pivotable frame to limit downward movement thereof; releasable fasteners coupling the fabric support to the main support frame and the pivotable frame; and a strap secured to the central extent of the cross leg of the pivotable frame.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved wall mounted child seats with fold-up capabilities which have all the advantages of the prior art child seats and none of the disadvantages.

It is another object of the present invention to provide new and improved wall mounted child seats with fold-up capabilities which may be easily and efficiently manufactured and marketed.

It is a further object of the present invention to provide new and improved wall mounted child seats with fold-up capabilities which are of durable and reliable constructions.

An even further object of the present invention is to provide new and improved wall mounted child seats with fold-up capabilities which are susceptible of a low cost of manufacture with regard to both materials and labor, and which accordingly are then susceptible of low prices of sale to the consuming public, thereby making such wall mounted child seats with fold-up capabilities economically available to the buying public.

Still yet another object of the present invention is to provide new and improved wall mounted child seats with fold-up capabilities which provide in the apparatuses and methods of the prior art some of the advantages thereof, while simultaneously overcoming some of the disadvantages normally associated therewith.

Lastly, it is an object of the present invention to provide a new and improved child seat positionable between an operative deployed orientation and an inoperative storage orientation comprising a child seat positionable between an operative deployed orientation and an inoperative storage orientation comprising a main support frame in a generally inverted U-shaped configuration having a pair of parallel vertical legs and a single horizontal leg coupled therebetween at the upper extent of the vertical leg; attachment means secured to each vertical leg at an upper extent thereof and at a lower extent thereof for coupling the main support frame to a horizontal surface such as the wall of a bathroom; a pivotable frame formed with linear parallel legs and with hinge means coupling the inboard end thereof to a central extent of the vertical legs of the main support frame intermediate the brackets, the pivotable frame also having an elongated cross leg at the outboard ends of the parallel legs; a flexible fabric cover having inboard ends coupled to the vertical and horizontal legs of the main support frame and outboard ends coupled to the parallel and cross leg of the pivotable frame; and a strap coupling intermediate extents of the vertical legs of the main support frame and the parallel legs of the pivotable frame to limit downward movement thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of the preferred embodiment of the wall mounted child seats with fold-up capabilities constructed in accordance with the principles of the present invention.

FIG. 2 is a side elevational view of the wall mounted child seats with fold-up capabilities as shown in FIG. 1.

FIG. 3 is a view similar to FIG. 2 but illustrating the seat in a collapsed orientation.

FIG. 4 is a sectional view of the device of the prior Figures taken along line 4—4 of FIG. 2.

The same reference numerals refer to the same parts throughout the various Figures.

DESCRIPTION OF THE PREFERRED EMBODIMENT

Figure 5:
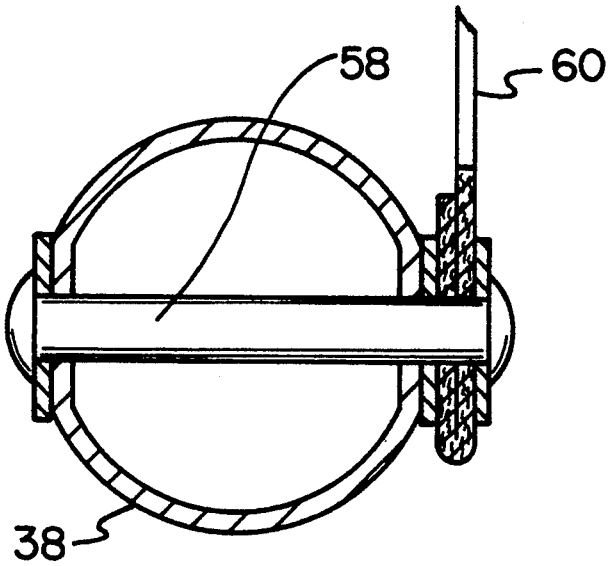
FIG. 5 is a sectional view of the device of the prior Figures taken along line 5—5 of FIG. 2.

With reference now to the drawings, and in particular to FIG. 1 thereof, the preferred embodiment of the new and improved wall mounted child seat with fold-up capabilities embodying the principles and concepts of the present invention and generally designated by the reference numeral 10 will be described.

Figure 6:
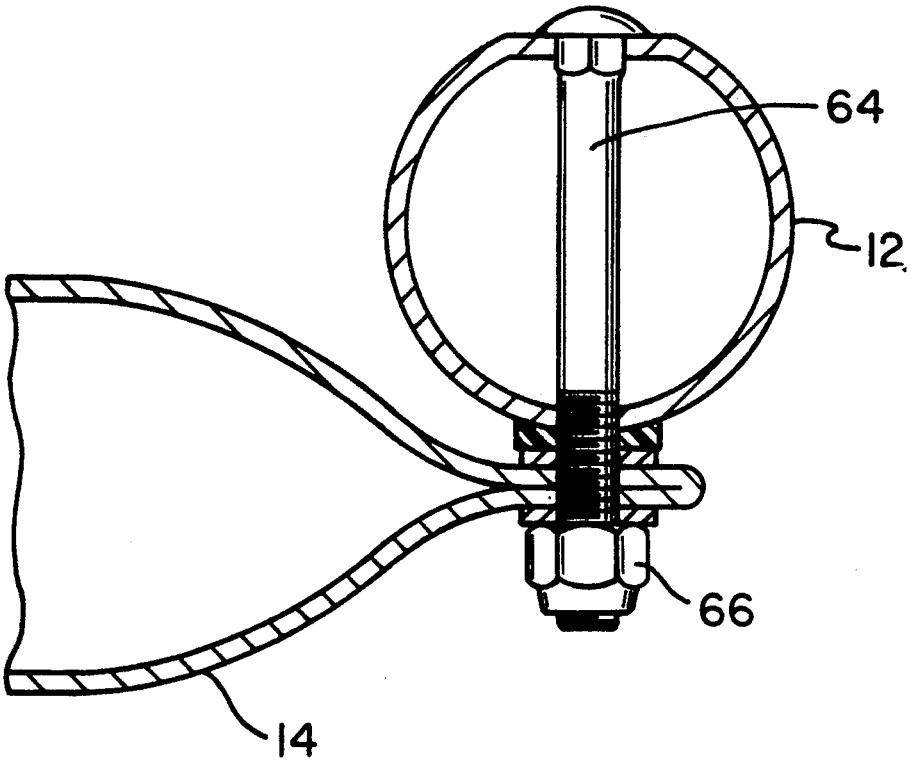
FIG. 6 is a sectional view of the device of the prior Figures taken along line 6—6 of FIG. 2.

More specifically, it will be noted with particular reference to FIGS. 1 through 6, there is disclosed a child seat 10 which is positionable between an operative deployed orientation, note FIGS. 1 and 2, and an inoperative storage orientation, note FIG. 3. The seat comprises, in its broadest of terms, a main support 12, a pivotable frame 14, a fabric cover 16 and coupling components therebetween.

More specifically, the main support frame 12 is formed of a rigid tubular member in a generally inverted U-shaped configuration. It has a pair of parallel vertical legs 20 and a single horizontal leg 22 coupled therebetween. Such horizontal leg 22 is located at the upper extent of the vertical legs.

Attachment means are secured to each vertical leg at an upper extent thereof and at a lower extent thereof. Such attachment means are in the form of apertured brackets 26 for coupling the main support frame 12 to a horizontal surface 28 such as the wall of a bathroom.

The next major component of the seat 10 is a pivotable frame 14. Such pivotable frame 14 is formed with linear parallel legs 34. Hinges 36 couple the inboard ends of the pivotable frame 14 to a central extent of the vertical legs 20 of the main support frame 12. The hinges are located on the main support frame intermediate the brackets 26. The pivotable frame also has an elongated cross leg 38 formed integrally at its ends with the outboard ends of the parallel legs 34.

The pivotable frame 14 and main support frame 12 are fabricated of a rigid tubular material, either metal or, preferably, plastic.

The final component of the seat 10 is a flexible fabric cover 16. The cover has inboard ends 44 coupled to the vertical and horizontal legs of the main support frame 12. The cover has side and outboard ends 46 coupled to the parallel legs and cross leg of the pivotable frame 14. The cover is of a washable fabric preferably plastic.

Releasable fasteners located at the periphery of the fabric cover 16 releasably couple the fabric cover to the main support frame 12 and the pivotable frame 14 by snaps 52. Permanent fasteners couple together the various components of the seat. Specifically an adhesive or weldment 54 couples the brackets 26 to the main support frame 12. Note FIG. 4. A rivet 58 couples the lower end of a flexible strap 60 as well as its upper end to the central extents of the pivotable frame 14 and main support frame 12 to limit downward movement of the pivotable frame to the deployed orientation of FIGS. 1 and 2. Note FIG. 5. A carriage bolt 64 with nut 66 forms the hinge between the pivotable main support frames 14 and 12. Note FIG. 6.

The last component of the seat 10 is a strap 70 secured to the central extent of the cross leg 38 of the pivotable support 14. The strap 70 has a ring 72 releasably secured thereto by snap 74 for the temporary attachment of accessories or the like.

The present invention is a seat designed to hold babies up to walking age, approximately 25–30 pounds and/or infants. The seat will be placed in designated bathroom stalls, men or women, and attached to the door or wall. It can be stored in a folded manner and conveniently lowered when needed by a parent or care giver.

The present invention consists of a back framework, aluminum or fiberglass tubing, 2 feet high by 15 inches wide, 3 bolts and padded back and nylon straps. The material for the seat and snaps to be attached to tubing for the seat to be snapped on so that the seat can be removed and cleaned or replaced.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved child seat positionable between an operative deployed orientation and an inoperative storage orientation comprising, in combination:

a main support frame in a generally inverted U-shaped configuration having a pair of parallel vertical legs and a single horizontal leg coupled therebetween at the upper extent of the vertical leg;

attachment means secured to each vertical leg at an upper extent thereof and at a lower extent thereof for coupling the main support frame to a surface such as the wall of a bathroom;

a pivotable frame formed with linear parallel legs having inboard ends and outboard ends and with hinge means coupling the inboard end thereof to a central extent of the vertical legs of the main support frame intermediate the attachment means, the pivotable frame also having an elongated cross leg at the outboard ends of the parallel legs;

a flexible fabric cover having inboard ends coupled to the vertical and horizontal legs of the main support frame and outboard ends coupled to the parallel and cross leg of the pivotable frame;

attachment strap coupling intermediate extents of the vertical legs of the main support frame and the parallel legs of the pivotable frame to limit downward movement thereof;

a fabric support having inboard ends coupled to the vertical and horizontal legs of the main support frame and outboard ends coupled to the parallel and crogs leg of the pivotable frame;

releasable fasteners coupling the fabric support to the main support frame and the pivotable frame; and an accessory strap secured to the central extent of the cross leg of the pivotable frame for temporary attachment of accessories.

2. A child seat positionable between an operative deployed orientation and an inoperative storage orientation comprising:

a main support frame in a generally inverted U-shaped configuration having a pair of parallel vertical legs and a single horizontal leg coupled therebetween at the upper extent of the vertical leg;

attachment means secured to each vertical leg at an upper extent thereof and at a lower extent thereof for coupling the main support frame to a vertical surface such as the wall of a bathroom;

a pivotable frame formed with linear parallel legs having inboard ends and outboard ends and with hinge means coupling the inboard end thereof to a central extent of the vertical legs of the main support frame intermediate the attachment means, the pivotable frame also having an elongated cross leg at the outboard ends of the parallel legs;

a flexible fabric cover having inboard ends coupled to the vertical and horizontal legs of the main support frame and outboard ends coupled to the parallel and cross leg of the pivotable frame; and an attachment strap coupling intermediate extents of the vertical legs of the main support frame and the parallel legs of the pivotable frame to limit downward movement thereof.

3. The seat as set forth in claim 2 and further including releasable fasteners coupling the fabric support to the main support frame and the pivotable frame.

4. The seat as set forth in claim 2 and further including an accessory strap secured to the central extent of the cross leg of the pivotable support for temporary attachment of accessories.

* * * * *